US005716915A

United States Patent [19]

Brown et al.

[11] Patent Number: 5,716,915

[45] Date of Patent: Feb. 10, 1998

[54] OIL COMPOSITIONS

[75] Inventors: Gerald Ivan Brown, Wantage; Lain More; Robert Dryden Tack, both of Abingdon; Brian William Davies, Blewbury; Derek A. Towe, Wantage, all of United Kingdom

[73] Assignee: Exxon Chemical Patents Inc., Linden, N.J.

[21] Appl. No.: 663,163

[22] PCT Filed: Feb. 22, 1995

[86] PCT No.: PCT/EP95/00666

§ 371 Date: Oct. 3, 1996

§ 102(e) Date: Oct. 3, 1996

[87] PCT Pub. No.: WO95/23200

PCT Pub. Date: Aug. 31, 1995

[30] Foreign Application Priority Data

Feb. 25, 1994 [GB] United Kingdom ..... 9403660

[51] Int. Cl.$^6$ ..... C10M 145/10; C10L 1/18

[52] U.S. Cl. ..... 508/467; 508/468; 44/393

[58] Field of Search ..... 508/467, 468

[56] References Cited

U.S. PATENT DOCUMENTS

| | | | |
|---|---|---|---|
| 2,721,877 | 10/1955 | Popkin et al. | 508/468 |
| 2,721,879 | 10/1955 | Popkin et al. | 508/468 |
| 2,906,729 | 9/1959 | Popkin | 508/468 |
| 2,936,300 | 5/1960 | Tutwiler et al. | 508/467 |
| 3,304,261 | 2/1967 | Ilnyckyj et al. | 508/467 |
| 3,764,537 | 10/1973 | Macleod | 508/468 |
| 3,814,690 | 6/1974 | Song | 508/467 |
| 4,548,725 | 10/1985 | Bridger | 508/468 |
| 4,826,615 | 5/1989 | Rossi et al. | 508/468 |
| 4,839,074 | 6/1989 | Rossi et al. | 508/468 |
| 4,863,486 | 9/1989 | Tack et al. . | |
| 5,011,505 | 4/1991 | Lewtas et al. | 508/467 |
| 5,045,088 | 9/1991 | More et al. | 44/400 |
| 5,435,928 | 7/1995 | Beck | 508/468 |

FOREIGN PATENT DOCUMENTS

| | | |
|---|---|---|
| 282342 A1 | 9/1988 | European Pat. Off. . |
| 1469016 | 3/1977 | United Kingdom . |
| 2023645 | 1/1980 | United Kingdom . |

*Primary Examiner*—Ellen M. McAvoy
*Attorney, Agent, or Firm*—John J. Mahon

[57] ABSTRACT

Additives having certain hydrocarbyl groups improve the low temperature properties of hydrocarbon oils.

5 Claims, No Drawings

OIL COMPOSITIONS

This invention concerns oil compositions having improved low temperature properties, and additives imparting such properties to hydrocarbon oils.

The general problem of decreased hydrocarbon oil flowability at low temperatures is well recognised in the art. Hydrocarbon oils typically contain normal alkanes which precipitate from the bulk oil at and below oil cloud point temperature, forming wax crystals. These wax crystals modify the flow characteristics of the hydrocarbon oil, eventually forming a spongy mass which entraps the bulk oil.

One well-recognised solution to this problem is the use of chemical additives to improve the flowability of hydrocarbon oil at temperatures below cloud point. This improvement may result from additive interaction with the forming wax crystals, for example by reducing crystal size, the smaller wax crystals appearing less likely to clog fine filters. Other additives inhibit wax crystallisation into platelets, instead causing the adoption of acicular crystal habits which pass through the filter pores more readily. Many such low temperature flow improving additives have been described in the art.

However, such additives commonly exhibit the problem of having non-universal application across the range of hydrocarbon oil types. Typically, a particular additive will prove effective only in oils sharing certain physical characteristics, and will prove largely ineffective in other oils. It is a continual challenge to devise additives effective in a range of oils, and particularly in those oils hitherto regarded in the art as difficult to treat with conventional low-temperature flow improving additives.

Comb polymers generally have one or more long chain substituents pendant from a polymer backbone, said substituents being bonded either directly to the backbone or indirectly to the backbone via interposed atoms or groups. Comb polymers are discussed in "Comb-like Polymers, Structure and Properties" by N. A. Platé and V. P. Shibaev, published in J. Poly. Sci, Macromolecular Revs. 8, p. 117 to 253 (1974). A number of classes of comb polymer useful as low temperature flow improving additives have been described in the art.

UK Patent No. 1,469,016 describes comb polymers derived from $C_6$ to $C_{18}$ alkyl esters of unsaturated $C_4$ to $C_8$ dicarboxylic acids, with copolymers of di-n-alkyl fumarates and vinyl acetate being preferred. Such comb polymers are shown to be effective as low temperature flow improvers only in fuel oils having high end points, i.e. final boiling points above 700° F. (371° C.).

European Patent Application No. 0,282,342 describes comb polymers derived from a $C_2$ to $C_{17}$ alpha-olefin or aromatic substituted olefin, and a mono- or di- $C_8$ to $C_{23}$ alkyl ester of certain unsaturated carboxylic acids. Such polymers are shown to be effective as low temperature flow improvers only in fuel oils having a relatively high final boiling point of above 360° C.

UK Patent No. 2,023,645 describes a three component additive combination for fuel oils, in which "Component B" is a comb polymer having hydrocarbyl substituents in the form of straight chain alkyl groups of 6 to 30 carbon atoms. Such additive combinations are shown to be effective as low temperature flow improvers and as inhibitors of wax settling only in fuels having final boiling points of at least 361° C.

The known comb polymers hereinbefore described have not proved substantially advantageous in hydrocarbon oils lacking the physical characteristic of high final boiling point.

WO 94/00386 discloses oil soluble ethylene polymers having, in addition to units derived from ethylene, units of the formulas $$—CH_2—CRR^1—$$

and $$—CH_2—CRR^2—,$$

wherein each R independently represents H or $CH_3$, and each $R^1$ and $R^2$ independently represents a group of the formula $COOR^3$ or $OOCR^4$, wherein $R^3$ and $R^4$ independently represent hydrocarbyl groups of, most preferably, at most 8 carbon atoms. Specifically-disclosed examples include ethylene vinyl n-octanoate (Example G) and ethylene vinyl n-heptanoate (Example F).

U.S. Pat. No. 4,863,486 discloses a class of comb polymer surprisingly effective as a low temperature flow improver for distillate fuel oils which have a relatively narrow and/or low boiling range, and which are regarded as difficult to treat. Such fuel oils are described as having at least one of the following characteristics:

(a) a final boiling point in the range of 340° C. to 370° C.

(b) 20% and 90% distillation points differing by less than 100° C.

(c) 90% distillation point and final boiling point differing by between 10° C. and 25° C.

The comb polymers disclosed as effective in these fuels comprise at least 25% wt of a monomer being the n-alkyl ester of a mono-ethylenically unsaturated $C_3$–$C_8$ mono- or dicarboxylic acid, the average number of carbon atoms (hereinafter "average carbon number") in the n-alkyl groups being from 12 to 14 and the proportion of individual n-alkyl groups having more than 14, or less than 12, carbon atoms being strictly limited. Comb polymers having n-alkyl groups (i.e. hydrocarbyl substituents) not in accordance with this average carbon number range are shown to be ineffective in such fuels.

Hydrocarbon oils—and particularly fuel oils—currently produced for winter use in many Scandinavian, North American and other cold regions typically have cloud points of −10° C. or below. Such oils often have a narrow and/or low boiling range, and also often have a low final boiling point. These oils are particularly difficult to treat with low-temperature flow improving additives. In particular, low cloud point oils appear, on cooling, to exhibit higher rates of wax crystallisation once the cloud point is reached. This rapid deposition of solid wax appears to interfere with the action of conventional low temperature flow improvers.

In particular, we have found that the additives described in U.S. Pat. No. 4,863,486 as advantageous for distillate fuel oils having a relatively narrow and/or low boiling range are largely ineffective in oils having a cloud point no higher than −10° C., notwithstanding the distillation characteristics of these low cloud point oils. Surprisingly, we have now found that the low temperature flowability of such low cloud point oils may be successfully improved through the use of comb polymers having hydrocarbyl substituents of average carbon number below 12. This improved oil flowability accordingly allows a mechanical system or device dependent, for normal operation, upon the flowability of these hydrocarbon oils to remain operational at lower temperatures.

In a first aspect therefore, this invention provides an oil composition comprising a major proportion of hydrocarbon oil having a cloud point no higher than −10° C. and a minor proportion of an additive comprising a comb polymer containing units of the general formula (I)

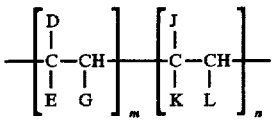

(I)

wherein

D represents $COOR^{11}$, $OCOR^{11}$ or $OR^{11}$ groups,

E represents H, $CH_3$, D or $R^{12}$ groups,

G represents H or D group,

J represents H, $R^{12}$ or an aryl or heterocyclic group,

K represents H, $COOR^{12}$, $OCOR^{12}$, $OR^{12}$ or COOH groups,

L represents H, $R^{12}$, $COOR^{12}$, $OCOR^{12}$ or aryl groups, and wherein $R^{11}$ and $R^{12}$ each represent hydrocarbyl substituents of average carbon number below 12 as measured over all units in the polymer, and wherein m and n represent mole ratios, their sum being 1 and m being finite and being up to and including 1 and n being from zero to less than 1, provided that E, G, J, K and L do not each represent H when D represents $COOR^{11}$ or $OCOR^{11}$.

In a second aspect, this invention provides the use of an additive of the first aspect for improving the low temperature flow properties of a hydrocarbon oil having a cloud point no higher than −10° C.

In a third aspect, this invention provides the use of the oil composition of the first aspect in a mechanical system or device dependent, for normal operation, upon the flowability of hydrocarbon oil.

The invention is hereinafter described in more detail.

The Comb Polymer [of all aspects of the invention]

The hydrocarbyl substituents $R^{11}$ and $R^{12}$ are each of average carbon number below 12, preferably no higher than 11.75, more preferably no higher than 11, and most preferably about 10. An average carbon number of 10 is especially advantageous.

In accordance with preferred embodiments of the invention, the hydrocarbyl substituents $R^{11}$ and $R^{12}$ each suitably have an average carbon number of above 8, and more suitably at least 9.

An individual unit (I) within the polymer may have hydrocarbyl substituents $R^{11}$ and $R^{12}$ which contain a different number of carbon atoms from those substituents in neighbouring units, provided that the relative proportions of different units within the polymer are such as to give the required average carbon number. Preferably, however, the individual units have hydrocarbyl substituents containing approximately the same number of carbon atoms, such that the average carbon number for each of $R^{11}$ and $R^{12}$ is approximately equal to their carbon number 5 in individual units. More preferably, the average carbon number for each of $R^{11}$ and $R^{12}$ is approximately equal to their carbon number in the predominant individual unit. Advantageously, all the individual units have substituents containing the same number of carbon atoms.

As used throughout this specification and not only in relation to the comb polymer, the term "hydrocarbyl" refers to a group being composed substantially or exclusively of carbon and hydrogen atoms such that the group is oleophilic in nature. Among these, there may be mentioned aliphatic, (e.g., alkyl or alkenyl), alicyclic (e.g., cycloalkyl or cycloalkenyl), aromatic, aliphatic- and alicyclic-substituted aromatic, and aromatic-substituted aliphatic and alicyclic groups. Aliphatic groups are advantageously saturated.

Hydrocarbyl groups may contain substituents comprising hetero-atoms, provided they do not alter the oleophilic nature of the group. Examples include keto, halo, hydroxy, nitro, cyano, alkoxy, ester and acyl. If the hydrocarbyl group is substituted, a single (mono) substituent is preferred. Examples of substituted hydrocarbyl groups include 2-hyroxyethyl, 3-hydroxypropyl, 4-hydroxybutyl, 2-ketopropyl, ethoxyethyl, and propoxypropyl. The groups may also or alternatively contain hetero-atoms in a chain or ring otherwise composed of carbon atoms. Suitable hetero-atoms include, for example, nitrogen, oxygen and sulfur.

The term "hydrocarbon" is used analogously throughout this specification.

In accordance with preferred embodiments of the invention, the individual hydrocarbyl substituents $R^{11}$ and $R^{12}$ are alkyl groups, and preferably n-alkyl groups such as n-octyl, n-nonyl, n-decyl, n-undecyl and n-dodecyl.

Preferably, D represents $COOR^{11}$ or $OCOR^{11}$ and E, G, J, K and L do not each represent H.

Particularly preferred embodiments are those in which $R^{12}$ represents a hydrocarbyl substituent containing from 1 to 6 carbon atoms and wherein $R^{11}$ represents a hydrocarbyl substituent different from $R^{12}$ and of average carbon number below 12, and preferably above 8. In such embodiments, $R^{12}$ is advantageously subject to the preferments for average carbon number hereinbefore described. Thus, for example, the individual units of the polymer preferably have $R^{11}$ substituents containing substantially the same number of carbon atoms.

The number average molecular weight of the polymers may, for example, be in the range of 1,000 to 120,000, preferably 1,000 to 50,000, more preferably 2,000 to 25,000, and most preferably 3,000 to 15,000 as measured by Vapour Phase Osmometry (VPO).

Examples of particularly advantageous comb polymers include copolymers of one or more esters of an ethylenically unsaturated carboxylic acid such as maleic anhydride or fumaric acid and another ethylenically unsaturated monomer such as an α-olefin or an unsaturated ester, for example vinyl acetate. It is preferred but not essential that equimolar amounts of the comonomers be used although molar proportions in the range of 2 to 1 and 1 to 2 are suitable. Examples of olefins that may be copolymerized with e.g. maleic anhydride include 1-octene, 1-decene, 1-dodecene and 1-tetradecene.

The copolymer may be esterified by any suitable technique and although preferred it is not essential that the maleic anhydride or fumaric acid be at least 50% esterified. Examples of alcohols which may be used include octan-1-ol, nonanol-1-ol, decanol-1-ol, undecan-1-ol, dodecan-1-ol and tetradecan-1-ol. The alcohols may also include up to one methyl branch per chain, for example, 1-methyldecan-1-ol, 2-methyldecan-1-ol. The alcohol may be a mixture of normal and single methyl branched alcohols. Preferably, the alcohol contains only normal alcohols. It is preferred to use pure alcohols rather than the commercially available alcohol mixtures.

Particularly preferred comb polymers are copolymers of alkyl fumarates and vinyl acetate made, for example, by solution copolymerizing an equimolar mixture of fumaric acid and vinyl acetate and reacting the resulting copolymer with the alcohol or mixture of alcohols, which are preferably straight chain alcohols. The particularly preferred fumarate comb polymers may, for example, have a number average molecular weight in the range of 1,000 to 100,000, preferably 1,000 to 30,000, more preferably 2,000 to 20,000, as measured by Vapour Phase Osmometry (VPO).

Other examples of particularly advantageous comb polymers are the copolymers of α-olefins, esterified copolymers of styrene and maleic anhydride, and esterified copolymers of styrene and fumaric acid. Further examples include those copolymers of esters of other ethylenically unsaturated carboxylic acids such as acrylic acid, methacrylic acid, itaconic acid and crotonic acid. Copolymers of these esters with vinyl esters of saturated carboxylic acids, in particular vinyl acetate and vinyl proprionate, are especially suitable.

The comb polymers are generally prepared by polymerising the monomers in a solution of a hydrocarbon solvent such as heptane, benzene, cyclohexane, or white oil, at a temperature generally in the range of from 20° C. to 150° C., and usually promoted with a peroxide or azo type catalyst such as benzoyl peroxide or azodiisobutyronitrile, under a blanket of an inert gas such as nitrogen or carbon dioxide in order to exclude oxygen. The polymer may be prepared under pressure in an autoclave, or by refluxing or other polymerisation methods known to the man skilled in the art.

Two or more comb polymers in accordance with this invention may be used, in combination, to advantageous effect.

The Additive [of all aspects of this invention]

The additive comprises the above-described comb polymer, or a mixture of such comb polymers, optionally in the form of a concentrate. In such a concentrate, the copolymer(s) may be dissolved in a solvent at a concentration within wide limits according to the needs and restrictions of the specific application, for example from 1:90, such as 10:80, percent (weight:weight). Examples of suitable solvents are hydrocarbons or oxygen-containing hydrocarbons such as kerosene, aromatic naphthas, and mineral lubricating oils.

The concentration of the additive in the oil may for example be in the range of 1 to 5,000 ppm of additive (active ingredient) by weight per weight of oil, for example 10 to 5,000 ppm such as 10 to 2000 ppm (active ingredient) by weight per weight of oil, preferably 25 to 500 ppm, more preferably 100 to 200 ppm.

The additive or additives should be soluble in the oil to the extent of at least 1000 ppm by weight of oil at ambient temperature. However, at least some of the additive may come out of solution near the cloud point of the oil in order to modify the wax crystals that form.

The one or more comb polymers in accordance with this invention may also be used in combination with co-additives, in particular conventional low temperature flow improvers, to advantageous effect. Preferably therefore, the additive of all aspects of the invention comprises one or more of the additional low temperature flow improvers hereinafter described.

Additional low temperature flow improvers:

Such co-additives may be selected from the following:

(i) a linear compound, (ii) an ethylene/unsaturated ester copolymer, (iii) a polar, organic, nitrogen-containing wax crystal growth inhibitor (iv) a hydrocarbon polymer (v) a sulphur carboxy compound, and (vi) a hydrocarbylated aromatic.

These additional low temperature flow improvers will now be discussed in more detail.

(i) Linear Compounds

Such compounds comprise a compound in which at least one substantially linear alkyl group having 10 to 30 carbon atoms is connected to a non-polymeric organic residue to provide at least one linear chain of atoms that includes the carbon atoms of said alkyl groups and one or more non-terminal oxygen atoms.

By "substantially linear" is meant that the alkyl group is preferably straight chain, but that essentially straight chain alkyl groups having a small degree of branching such as in the form of a single methyl group may be used.

Preferably, the compound has a least two of said alkyl groups when the linear chain may include the carbon atoms of more than one of said alkyl groups. When the compound has at least three of said alkyl groups, there may be more than one of such linear chains, which chains may overlap. The linear chain or chains may provide part of a linking group between any two such alkyl groups in the compound.

The oxygen atom or atoms are preferably directly interposed between carbon atoms in the chain and may, for example, be provided in the form of a mono- or polyoxyalkylene group, said oxyalkylene group preferably having 2 to 4 carbon atoms, examples being oxyethylene and oxypropylene.

As indicated the chain or chains include carbon and oxygen atoms. They may also include other hetero-atoms such as nitrogen atoms.

The compound may be an ester where the alkyl groups are connected to the remainder of the compound as —O—CO n alkyl, or —CO—O n alkyl groups, in the former the alkyl groups being derived from an acid and the remainder of the compound being derived from a polyhydric alcohol and in the latter the alkyl groups being derived from an alcohol and the remainder of the compound being derived from a polycarboxylic acid. Also, the compound may be an ester where the alkyl groups are connected to the remainder of the compound as —O—n—alkyl groups. The compound may be both an ester and an ether or it may contain different ester groups.

Examples are polyoxyalkylene esters, ethers, ester/ethers and mixtures thereof, particularly those containing at least one, preferably at least two $C_{10}$ to $C_{30}$ linear saturated alkyl groups and a polyoxyalkylene glycol group of molecular weight up to 5,000 preferably 200 to 5,000, the alkyl group in said polyoxyalkylene glycol containing from 1 to 4 carbon atoms. These materials form the subject of European Patent Publication 0 061 895 A2. Other such additives are described in U.S. Pat. No. 4,491,455.

The preferred esters, ethers or ester/ethers which may be used may be structurally depicted by the formula $$R^7—O(A)—O—R^8$$

where $R^7$ and $R^8$ are the same or different and may be

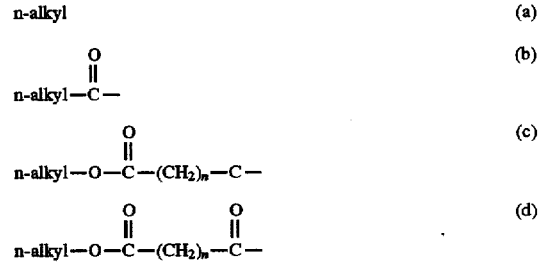

n being, for example, 1 to 30, the alkyl group being linear and saturated and containing 10 to 30 carbon atoms, and A representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. A may also contain nitrogen.

Examples of suitable glycols are substantially linear polyethylene glycols (PEG) and polypropylene glycols (PPG) having a molecular weight of about 100 to 5,000, preferably about 200 to 2,000. Esters are preferred and fatty acids containing from 10 to 30 carbon atoms are useful for reacting with the glycols to form the ester additives, it being preferred to use a $C_{18}$ to $C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates when minor amounts of monoethers and monoesters (which are often formed in the manufacturing process) may also be present. It is important for additive performance that a major amount of the dialkyl compound is present. In particular, stearic or behenic diesters of polyethylene glycol, polypropylene glycol or polyethylene/polypropylene glycol mixtures are preferred.

Other examples of polyoxyalkylene compounds are those described in Japanese Patent Publication Nos. 2-51477 and 3-34790 (both Sanyo), and the esterified alkoxylated amines described in EP-A-117, 108 and EP-A-326,356 (both Nippon Oil and Fats).

(ii) Ethylene/Unsaturated Ester Copolymers

Ethylene copolymer flow improvers have a polymethylene backbone divided into segments by oxyhydrocarbon side chains, i.e. ethylene unsaturated ester copolymer flow improvers. The unsaturated monomers copolymerisable with ethylene to form the copolymers include unsaturated mono and diesters of the general formula:

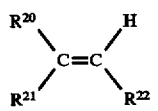

wherein $R^{20}$ represents hydrogen or a methyl group;

$R^{21}$ represents a —$OOCR^{23}$ or —$COOR^{23}$ group wherein $R^{23}$ represents hydrogen or a $C_1$ to $C_8$, straight or branched chain alkyl group, provided that $R^{23}$ does not represent hydrogen when $R^{21}$ represents —$COOR^{23}$; and $R^{22}$ is hydrogen or —$COOR^{23}$.

The monomer, when $R^{20}$ and $R^{22}$ are hydrogen and $R^{21}$ is —$OOCR^{23}$, includes vinyl alcohol esters of $C_1$ to $C_8$, preferably $C_1$ to $C_5$, monocarboxylic acids, and most preferably $C_2$ to $C_5$ monocarboxylic acids. Examples of vinyl esters which may be copolymerised with ethylene include vinyl acetate, vinyl propionate and vinyl butyrate or isobutyrate, vinyl acetate and vinyl propionate being preferred. Preferably, the copolymers contain from 5 to 40 wt % of the vinyl ester, more preferably from 10 to 35 wt % vinyl ester. They may also be in the form of mixtures of two copolymers such as those described in U.S. Pat. No. 3,961,916. Preferably, number average molecular weight of the copolymer as measured by vapour phase osmometry is 1,000 to 10,000, more preferably 1,000 to 5,000. If desired, the copolymers may be derived from additional comonomers, e.g. they may be terpolymers or tetrapolymers or higher polymers, for example where the additional comonomer is isobutylene or diisobutylene.

Such copolymers may also be made by transesterification, or by hydrolysis and re-esterification, of an ethylene unsaturated ester copolymer to give a different ethylene unsaturated ester copolymer. For example, ethylene vinyl hexanoate and ethylene vinyl octanoate copolymers may be made in this way, e.g. from an ethylene vinyl acetate copolymer.

(iii) Polar Organic, Nitrogen-containing Compounds

The oil-soluble polar nitrogen compound is either ionic or non-ionic and is capable of acting as a wax crystal growth inhibitor in fuels. It comprises for example one or more of the compounds (a) to (c) as follows:

(a) An amine salt and/or amide formed by reacting at least one molar proportion of a hydrocarbyl substituted amine with a molar proportion of a hydrocarbyl acid having 1 to 4 carboxylic acid groups or its anhydride.

Ester/amides may be used containing 30 to 300, preferably 50 to 150 total carbon atoms. These nitrogen compounds are described in U.S. Pat. No. 4,211,534. Suitable amines are usually long chain $C_{12}$ to $C_{40}$ primary, secondary, tertiary or quaternary amines or mixtures thereof but shorter chain amines may be used provided the resulting nitrogen compound is oil soluble and therefore normally contains about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but preferably are secondary. Tertiary and quaternary amines can only form amine salts. Examples of amines include tetradecyl amine, cocoamine, and hydrogenated tallow amine. Examples of secondary amines include dioctacedyl amine and methyl-behenyl amine. Amine mixtures are also suitable such as those derived from natural materials. A preferred amine is a secondary hydrogenated tallow amine of the formula $HNR^9R^{10}$ wherein $R^9$ and $R^{10}$ are alkyl groups derived from hydrogenated tallow fat composed of approximately 4% $C_{14}$, 31% $C_{16}$, 59% $C_{18}$.

Examples of suitable carboxylic acids and their anhydrides for preparing the nitrogen compounds include cyclohexane 1,2 dicarboxylic acid, cyclohexene 1,2 dicarboxylic acid, cyclopentane 1,2 dicarboxylic acid and naphthalene dicarboxylic acid, and 1,4-dicarboxylic acids including dialkyl spirobislactone. Generally, these acids have about 5 to 13 carbon atoms in the cyclic moiety. Preferred acids useful in the present invention are benzene dicarboxylic acids such as phthalic acid, isophthalic acid, and terephthalic acid. Phthalic acid or its anhydride is particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates such as described in EP-A-327,423.

(b) A chemical compound comprising or including a cyclic ring system, the compound carrying at least two substituents of the general formula (I) below on the ring system $$—A—NR^{13}R^{14} \quad (I)$$

where A is an aliphatic hydrocarbyl group that is optionally interrupted by one or more hetero atoms and that is straight chain or branched, and $R^{13}$ and $R^{14}$ are the same or different and each is independently a hydrocarbyl group containing 9 to 40 carbon atoms optionally interrupted by one or more hetero atoms, the substituents being the same or different and the compound optionally being in the form of a salt thereof.

Preferably, A has from 1 to 20 carbon atoms and is preferably a methylene or polymethylene group.

Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen.

The cyclic ring system may include homocyclic, heterocyclic, or fused polycyclic assemblies, or a system where two or more such cyclic assemblies are joined to one another and in which the cyclic assemblies may be the same or different. Where there are two or more such cyclic assemblies, the substituents of the general formula (I) may be on the same or different assemblies, preferably on the same assembly. Preferably, the or each cyclic assembly is aromatic, more preferably a benzene ring. Most preferably, the cyclic ring system is a single benzene ring when it is preferred that the substituents are in the ortho or meta positions, which benzene ring may be optionally further substituted.

The ring atoms in the cyclic assembly or assemblies are preferably carbon atoms but may for example include one or more ring N, S or O atom, in which case or cases the compound is a heterocyclic compound.

Examples of such polycyclic assemblies include:

(i) condensed benzene structures such as naphthalene, anthracene, phenanthrene, and pyrene;

(ii) condensed ring structures where none of or not all of the rings are benzene such as azulene, indene, hydroindene, fluorene, and diphenylene oxide;

(iii) rings joined "end-on" such as diphenyl;

(iv) heterocyclic compounds such as quinoline, indole, 2:3 dihydroindole, benzofuran, coumarin, isocoumarin, benzothiophen, carbazole and thiodiphenylamine;

(v) non-aromatic or partially saturated ring systems such as decalin (i.e. decahydronaphthalene), α-pinene, cardinene, and bornylene; and (vi) three-dimensional structures such as norbornene, bicycloheptane (i.e. norbornane), bicyclooctane, and bicyclooctene.

Each hydrocarbyl group constituting $R^{13}$ and $R^{14}$ in the invention (Formula I) may for example be an alkyl or alkylene group or a mono- or polyalkoxyalkyl group. Preferably, each hydrocarbyl group is a straight chain alkyl group. The number of carbon atoms in each hydrocarbyl group is preferably 16 to 40, more preferably 16 to 24.

Also, it is preferred that the cyclic system is substituted with only two substituents of the general formula (I) and that A is a methylene group.

Examples of salts of the chemical compounds are the acetate and the hydrochloride.

The compounds may conveniently be made by reducing the corresponding amide which may be made by reacting a secondary amine with the appropriate acid chloride; and (c) A condensate of long chain primary or secondary amine with a carboxylic acid-containing polymer.

Specific examples include polymers such as described in GB-A-2,121,807, FR-A-2,592,387 and DE-A-3,941,561; and also esters of telemer acid and alkanoloamines such as described in U.S. Pat. No. 4,639,256; a long chain epoxide/amine reaction product which may optionally be further reacted with a polycarboxylic acid; and the reaction product of an amine containing a branched carboxylic acid ester, an epoxide and a mono-carboxylic acid polyester such as described in U.S. Pat. No. 4,631,071.

(iv) Hydrocarbon Polymers

Examples are those represented by the following general formula

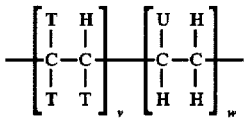

where

T=H or $R^{15}$

U=H, T or aryl $R^{15}$=$C_1$ to $C_{30}$ hydrocarbyl and v and w represent mole ratios, v being within the range 1.0 to 0.0, w being within the range 0.0 to 1.0.

These polymers may be made directly from ethylenically unsaturated monomers or indirectly by hydrogenating the polymer made from monomers such as isoprene and butadiene.

Preferred hydrocarbon polymers are copolymers of ethylene and at least one α-olefin, having a number average molecular weight of at least 30,000. Preferably the α-olefin has at most 20 carbon atoms. Examples of such olefins are propylene, 1-butene, isobutene, n-octene-1, isooctene-1, n-decene-1, and n-dodecene-1. The copolymer may also comprise small amounts, e.g. up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is, as indicated above, at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 percent. More advantageously, the ethylene content is within the range of from 57 to 80%, and preferably it is in the range from 58 to 73%, more preferably from 62 to 71%, and most preferably 65 to 70%.

Preferred ethylene-α-olefin copolymers are ethylene-propylene copolymers with a molar ethylene content of from 62 to 71% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. Advantageously, the polymers are substantially amorphous, since highly crystalline polymers are relatively insoluble in fuel oil at low temperatures.

The additive composition may also comprise a further ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar percent although for ethylene-propylene copolymers up to 86 molar percent by weight ethylene may be employed with advantage.

Examples of hydrocarbon polymers are described in WO-A-9 111 488.

(v) Sulphur Carboxy Compounds

Examples are those described in EP-A-0,261,957 which describes the use of compounds of the general formula

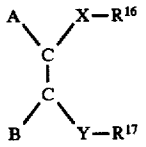

in which

—Y—$R^{17}$ is $SO_3(^-)(^+)NR18/3R^{17}$, —$SO_3(^-)(^+)HNR18/2R^{17}$, —$SO_3(-)(+)H_2NR^{18}R^{17}$, —$SO_3(-)(+)H_3R^{17}$, —$SO_2NR^{18}R^{17}$, —$SO_3(-)(+)H_3NR^{17}$;

—X—$R^{16}$ is —Y—$R^{17}$ or —$CONR^{18}R^{16}$, —$CO_2(-)(+)NR18/3R^{16}$, —$CO_2(-)(+)HNR18/2R^{16}$, —$R^{19}$—$COOR^{16}$, —$NR^{18}COR^{16}$, —$R^{19}OR^{16}$, —$R^{19}OCOR^{16}$, —$R^{19}.R^{16}$, —$N(COR^{18})R^{16}$ or $Z(-)(+)NR18/3R^{16}$;

—Z(−) is $SO_3(-)$ or —$CO_2(-)$;

$R^{16}$ and $R^{17}$ are alkyl, alkoxyalkyl or polyalkoxyalkyl containing at least 10 carbon atoms in the main chain;

$R^{18}$ is hydrocarbyl and each $R^{18}$ may be the same or different and $R^{19}$ is absent or is $C_1$ to $C_5$ alkylene and in

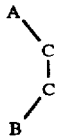

the carbon-carbon (C—C) bond is either a) ethylenically unsaturated when A and B may be alkyl, alkenyl or substituted hydrocarbyl groups or b) part of a cyclic structure which may be aromatic, polynuclear aromatic or cycloaliphatic, it is preferred that X-$R^{16}$ and Y-$R^{17}$ between them contain at least three alkyl, alkoxyalkyl or polyalkoxyalkyl groups.

(vi) Hydrocarbylated-Aromatics

These materials are condensates comprising aromatic and hydrocarbyl parts. The aromatic part is conveniently an aromatic hydrocarbon which may be unsubstituted or substituted with, for example, non-hydrocarbon substituents. Such an aromatic hydrocarbon preferably contains a maximum of these substituent groups and/or three condensed rings, and is preferably naphthalene. The hydrocarbyl part is a hydrogen and carbon containing part connected to the rest of the molecule by a carbon atom. It may be saturated or unsaturated, and straight or branched, and may contain one or more hetero-atoms provided they do not substantially affect the hydrocarbyl nature of the part. Preferably the hydrocarbyl part is an alkyl part, conveniently having more than 8 carbon atoms. The molecular weight of such condensates may, for example, be in the range of 2,000 to 200,000 such as 2,000 to 20,000, preferably 2,000 to 8,000. Examples are known in the art, primarily as lube oil pour depressants and dewaxing aids and they may, for example, be made by condensing a halogenated wax with an aromatic hydrocarbon. More specifically, the condensation may be a Friedel-Crafts condensation where the halogenated wax contains 15 to 60, e.g. 16 to 50, carbon atoms, has a melting point of about 200° to 400° C. and has been chlorinated to 5 to 25 wt % chlorine, e.g. 10 to 18 wt %. Another way of making similar condensates may be from olefins and the aromatic hydrocarbons.

Multicomponent additive systems may be used and the ratios of additives to be used will depend on the fuel to be treated.

In general, the additive of this invention is also suitable for use in hydrocarbon oils comprising other co-additives known in the art to impart beneficial properties to such oils. Amongst such other co-additives are the ashless dispersants described in numerous patent specifications, such as EP-A-O 482 253. Further examples include macrocyclic ashless dispersants, cetane improvers, polymers of monoolefins, metallic-based combustion improvers such as ferrocene, corrosion inhibitors, anti-oxidants, reoadorants, antiwear additives, various emissions-reducing agents, and those hereinafter described in relation to the hydrocarbon oil.

The addition of these other co-additives may be simultaneous with that of the additives hereinbefore described; for example, the additive of the invention may additionally comprise one or more of the desired other co-additives. Alternatively, the other co-additives may be added independent of the additive of the invention.

The Hydrocarbon Oil [of all aspects of this invention]

The hydrocarbon oil has a cloud point no higher than −10° C. In a preferred embodiment of this invention, the oil has a cloud point no higher than −12° C. and in a more preferred embodiment, no higher than −14° C. Hydrocarbon oils having cloud points no higher than −20° C. have proved particularly advantageous.

In this specification 'cloud point' refers to the physical characteristic determined in accordance with I.S.O. 3015 standard test procedure.

In general, the hydrocarbon oils useful in this invention may possess any distillation characteristics. However, in practice oils having the requisite low cloud point typically have relatively low final boiling points. Oils particularly suitable for this invention are therefore those having a final boiling point no higher than 370°, preferably no higher than 360° C., as measured by ASTM D-86.

Similarly, oils having the pre-requisite low cloud points typically exhibit relatively narrow boiling range. Such oils are particularly suitable for the invention and have 20% and 90% distillation points differing by less than 100° C., as measured by ASTM D-86.

Hydrocarbon oils having both relatively low final boiling points and relatively narrow boiling ranges, in addition to the pre-requisite low cloud points are especially suitable for this invention.

The hydrocarbon oil may be a crude oil, ie. an oil obtained directly from drilling and before refining.

The hydrocarbon oil may be a lubricating oil which may be an animal, vegetable or mineral oil, such as petroleum oil fractions ranging from naphthas or spindle oil to lubricating oil grades, castor oil, fish oils or oxidised mineral oil.

The hydrocarbon oil may preferably be a petroleum-based fuel oil, suitably a middle distillate fuel oil ie, a fuel oil obtained in refining crude oil as the fraction between the lighter kerosene and jet fuels fraction and the heavier fuel oil fraction. The petroleum-based fuel oil can comprise atmospheric distillate or vacuum distillate, or cracked gas oil or a blend in any proportion of straight run and thermally and/or catalytically cracked distillates. The most common petroleum-based fuel oils are kerosene, jet fuels, diesel fuel, heating oils and heavy fuel oils.

These fuel oils may have a sulphur concentration of 0.2% by weight or less based on the weight of the fuel oil. Preferably, the sulphur concentration os 0.05% by weight or less, more preferably 0.01% by weight or less. The art describes methods for reducing the sulphur concentration of middle distillate fuel oils, such methods including solvent extraction, sulphuric acid treatment, and hydrodesulphurisation.

The hydrocarbon oil may be an oil derived from animal or vegetable material. Generally, such oils contain glycerides of a number of acids, the number and kind varying with the source of the oil. Vegetable oils are mainly tricyclerides of monocarboxylic acids, eg. acids containing 10–25 carbon atoms and of the formula

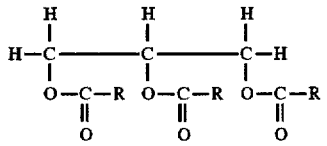

where R is an aliphatic radical of 10 to 25 carbon atoms which may be saturated or unsaturated. Examples of such oils are rapeseed oil, coriander oil, soyabean oil, cottonseed oil, sunflower oil, castor oil, olive oil, peanut oil, maize oil, almond oil, palm kernel oil, coconut oil and mustard seed oil. Rapeseed oil, which is a mixture of fatty acids partially esterified with glycerol, is preferred as it is available in large quantities and can be easily obtained by pressing from rapeseed.

Examples of derivatives of the fatty acids of vegetable or animal oils are alkyl esters, such as methyl esters. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, ie, to at least 50 wt % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, caster oil, soyabean oil, cottonseed oil, peanut oil or beef tallow. Lower alkyl esters of fatty acids based on a new variety of rapeseed oil, the fatty acid component of which is derived to more than 80 wt % from unsaturated fatty acids with 18 carbon atoms, are preferred.

The hereinbefore described hydrocarbon oils may contain certain additives, depending on the intended use of the oil. For example, where the hydrocarbon oil is a lubricating oil, it may contain viscosity index improvers such as ethylene-propylene copolymers, succinic acid based dispersants, metal containing dispersant additives and zinc dialkylodithiophosphate antiwear additives.

Where the hydrocarbon oil is a fuel oil, it may contain other additives such as stabilisers, dispersants, antioxidants, corrosion inhibitors, cetane improvers and/or demulsifiers.

The mechanical system or device [of the third aspect of this invention]

Suitable as the mechanical system or device are those mechanical systems or devices dependent for normal operation upon the flowability of hydrocarbon oil, particularly during periods where the oil temperature is below oil cloud point. Typical of such mechanical systems are hydrocarbon oil storage- and distribution-systems, often being complex arrangements of vessels in liquid communication and dependent upon oil flowability for efficient oil transport around the system, usually by means of pumps. Such systems are typically found in refineries, oil distribution terminals and networks, and on a smaller scale within appliances which utilise such oils, for example fuel oil installations and in-vehicle fuel oil systems. These mechanical systems typically contain devices such as filters and screens which strain insolubles from the oil and which are therefore themselves dependent, for normal operation, upon a continual through-flow of oil.

A decrease in oil flowability leads to a corresponding drop in oil passage through such systems and devices, reducing their efficiency of operation.

Using the oil compositions of this invention in such mechanical systems and devices, normal operation can continue at lower temperatures due to improved oil flowability, and particularly at lower temperatures below the oil composition cloud point.

However, such oil compositions may also be used at higher temperatures without detriment and provide assurance that, should oil composition temperature drop below cloud point, normal operation of the mechanical system or device will be maintained to lower temperatures.

The invention will now be illustrated by way of example only, as follows.

Examples of Comb Polymers

Comb polymers containing units of the formula (I) as hereinbefore described were prepared from the monomers in Table 1, using the standard polymerisation techniques also hereinbefore desribed.

Comparative polymers, being analogous to the above polymer examples but possessing larger hydrocarbyl substituents, were similarly prepared and are also shown in Table 1.

TABLE 1

COMB POLYMERS

| | 1st Monomer | | | Molar Ratio | Average carbon number of $R^{11}$ | Average carbon number of $R^{12}$ |
|---|---|---|---|---|---|---|
| Comb Polymer | Chemical Class | Carbon number of n-alkyl (ie. $R^{11}$) substituents | 2nd Monomer Chemical class | of 1st:2nd monomer in polymer | substituent as measured over all units in the polymer | substituent as measured over all units in the polymer |
| Polymer A | di-n-aikyl fumarate ester | 8 and 10 in a 1:1 ratio | vinyl acetate | 1:1 | 9 | 1 |
| Polymer B | di-n-aikyl fumarate ester | 10 only | " | " | 10 | 1 |
| Polymer C | di-n-aikyl fumarate ester | 10 and 12 in a 1:1 ratio | " | " | 11 | 1 |
| Polymer D | di-n-aikyl fumarate ester | 10 and 12 in a 1:3 ratio | " | " | 11.5 | 1 |

TABLE 1-continued

COMB POLYMERS

| Comb Polymer | 1st Monomer Chemical Class | 1st Monomer Carbon number of n-alkyl (ie. $R^{11}$) substituents | 2nd Monomer Chemical class | Molar Ratio of 1st:2nd monomer in polymer | Average carbon number of $R^{11}$ substituent as measured over all units in the polymer | Average carbon number of $R^{12}$ substituent as measured over all units in the polymer |
|---|---|---|---|---|---|---|
| Comparative Poiymer 1 | di-n-aikyl fumarate ester | 12 only | " | " | 12 | 1 |
| Comparative Polymer 2 | di-n-aikyl fumarate ester | 12 and 14 in a 1:1 ratio | " | " | 13 | 1 |

Examples of Hydrocarbon Oils

The petroleum-based middle distillate fuel oils characterised in Table 2 were used to illustrate the invention.

TABLE 2

OIL CHARACTERISTICS

| | Oils of the Invention | | | | Comparative Oils | |
|---|---|---|---|---|---|---|
| | A | B | C | D | E | F |
| I.S.O. 3015 Cloud Point (°C.) | −24 | −27 | −15 | −14 | −5 | −4 |
| E.N.116 (CFPP (°C.)) | −24 | −27 | −30 | −29 | −16 | −16 |
| ASTM D-86 Distillation | | | | | | |
| IBP | 182 | 190 | 157 | 140 | 162 | 171 |
| 20% | 219 | 222 | 218 | 220 | 240 | 248 |
| 50% | 248 | 240 | 259 | 267 | 283 | 268 |
| 90% | 297 | 280 | 307 | 324 | 331 | 330 |
| FBP | 329 | 320 | 357 | 350 | 359 | 356 |
| 90% − 20% | 78 | 58 | 89 | 104 | 91 | 82 |
| FBP − 90% | 32 | 40 | 50 | 26 | 28 | 26 |

Examples of the First and Second Aspects of the Invention

Oil compositions prepared by conventional blending techniques and illustrating the first aspect of the invention are defined in Table 3. The Cold Filter Plugging Point ('CFPP') of each composition was determined in accordance with the E.N. 116 standard test method, the CFPP values also being given in Table 3. The CFPP test is designed to correlate with the flow of a middle distillate fuel oil through the fuel systems of automotive diesels, at temperatures below oil composition cloud point. Fuel oils having greater flowability at such temperatures generally exhibit lower CFPPs.

In the CFPP test, a 40 ml sample of the oil is cooled in a bath maintained at about −34° C. to give non-linear cooling at about 1° C./min.

Periodically, the cooled oil is tested for its ability to flow through a fine screen in a prescribed time period, using a test device comprising a pipette to whose lower end is attached an inverted funnel which is positioned below the surface of the oil. Stretched across the mouth of the funnel is a 350 mesh screen having an area defined by a 12 millimeter diameter. Each periodic test is initiated by application of a vacuum to the upper end of the pipette, drawing oil through the screen up into the pipette until a mark indicating 20 ml of oil is reached. After each successful passage, the oil is returned immediately to the CFPP tube. The test is repeated with each one degree drop in temperature until 20 ml of oil fails to pass through the screen within 60 seconds, the temperature at which failure occurs being reported as the CFPP temperature.

In Table 3, Co-additives I, II and III and IV are additional low temperature flow improvers suitable for use with the comb polymers of this invention.

Co-additive I is a polyoxyalkylene compound of the type hereinbefore described under linear compounds, being a behenic acid diester of a polyethylene glycol mixture predominant in glycols of molecular weights 200, 400 and 600.

Co-additive II is similar to co-additive I, being a mixed stearic acid/behenic acid diester of the same ethylene glycol mixture.

Co-additive III is a polar organic, nitrogen-containing compound of the class hereinbefore described, being the amide-amine salt formed by reacting one molar proportion of phthalic anhydride with two molar proportions of the secondary hydrogenated tallow amine, Armeen 2HT.

Co-additive IV is a conventional low temperature flow improver believed to be one or more ethylene vinyl-acetate or similar copolymers, but of unknown detailed composition and unknown treat rate ('x' in Table 3). Co-additive IV was already present in fuel oils C and D prior to testing, both these fuels having been purchased commercially.

TABLE 3

| Example | Oil Composition | | | | | | | | | | | CFPP |
|---|---|---|---|---|---|---|---|---|---|---|---|---|
| | | Comb Polymer (ppm, a.i.) | | | | | | Co-Additive (ppm, a.i.) | | | | |
| No. | Oil | A | B | C | D | 1 | 2 | I | II | III | IV | (°C.) |
| 1. | A | — | — | — | — | — | — | — | — | — | — | −24 |
| 2. | A | 70 | — | — | — | — | — | 280 | — | — | — | −30.5 |
| 3. | A | — | 70 | — | — | — | — | 280 | — | — | — | −29.5 |
| 4. | A | — | — | 70 | — | — | — | 280 | — | — | — | −29.5 |
| 5. | A | — | — | — | 70 | — | — | 280 | — | — | — | −32 |
| 6. | A | — | — | — | — | — | 70 | 280 | — | — | — | −23 |
| 7. | B | — | — | — | — | — | — | — | — | — | — | −27 |
| 8. | B | — | 25 | — | — | — | — | — | 100 | — | — | −36 |
| 9. | B | — | — | 25 | — | — | — | — | 100 | — | — | −35 |
| 10. | B | — | — | — | 25 | — | — | — | 100 | — | — | −31 |
| 11. | B | — | -, | — | — | 25 | — | — | 100 | — | — | −31 |
| 12. | B | — | — | — | — | — | 25 | — | 100 | — | — | −27 |
| 13. | C | — | — | — | — | — | — | — | — | — | x | −30 |
| 14. | C | — | 120 | — | — | — | — | — | — | 120 | x | −32.5 |
| 15. | C | — | — | — | 120 | — | — | — | — | 120 | x | −31.5 |
| 16. | C | — | — | — | — | 120 | — | — | — | 120 | x | −29 |
| 17. | C | — | — | — | — | — | 120 | — | — | 120 | x | −25 |
| 18. | E | — | — | — | — | — | — | — | — | — | — | −5 |
| 19. | E | — | 150 | — | — | — | — | — | — | 150 | — | −19 |
| 20. | E | — | — | — | — | 150 | — | — | — | 150 | — | −23 |
| 21. | F | — | — | — | — | — | — | — | — | — | — | −4 |
| 22. | F | — | 150 | — | — | — | — | — | — | 150 | — | −17 |
| 23. | F | — | — | — | — | 150 | — | — | — | 150 | — | −22 |

— means 'not present'

The results in Table 3 clearly illustrate the greater low temperature flowability of oil compositions in accordance with the first aspect of the invention. The oil compositions of examples 2 to 5 inclusive, 8 to 10 inclusive, 14 and 15 exhibit lower CFPPs than either the base fuels (examples 1, 7 and 13 respectively) or the oil compositions containing comparative comb polymers (examples 6, 11 and 12, 16 and 17 respectively).

The results in Table 3 similarly illustrate the second aspect of the invention. The CFPPs of oils having a cloud point no higher that −10° C. (oils A, B and C) are effectively depressed by treatment with the comb polymers having hydrocarbyl substituents of average carbon number below 12, ie. Polymers A, B, C and D (examples 1 to 5 inclusive, 7 to 10 inclusive and 13 to 15 inclusive). In contrast, treatment of these oils with comparative polymers 1 or 2 has negligible effect upon the oil CFPP (examples 6, 11, 12, 16 and 17).

Similarly, comb polymers A to D inclusive prove less effective as CFPP depressants than comparative polymer 1 in fuels of cloud point higher than −10° C., ie. fuels E and F (examples 18 to 23 inclusive).

Oil compositions in accordance with this invention exhibit smaller wax crystals at temperatures below cloud point, consistent with their greater flowability at low temperatures. The oil composition defined in Table 4 were cooled from ambient temperature at 2° C. per hour until −25° C. was reached, where upon the wax crystals which had formed were photographed through an optical microscope.

TABLE 4

| Example | Oil Composition | | | | |
|---|---|---|---|---|---|
| | | Comb Polymer (ppm, ai) | | | Co-additive III (ppm, |
| No. | Oil | B | D | 1 | ai) |
| 26 | D | 180 | — | — | 180 |
| 27 | D | — | 180 | — | 180 |
| 28 | D | — | — | 180 | 180 |

— means 'not present'

Examples 26 and 27 (oil compositions comprising comb polymers in accordance with this invention) clearly exhibit far smaller wax crystals at −25% than example 28 (oil composition comprising a comb polymer not in accordance with this invention).

Example of the Third Aspect of the Invention

The CFPP results in Table 3 illustrate the greater flowability of oil compositions of the first aspect through a mechanical system comprising a fine screen (the CFPP testing apparatus).

The CFPP test was designed to correlate with the onset of automotive diesel engine system failure at low temperatures, this failure being due to fuel starvation resulting from the reduced flowability of the fuel oil through the vehicle fuel system. The lower CFPPs of the oil compositions of the first aspect thus indicate oil flowabilities sufficient to permit normal operation of such engine systems at lower temperatures, providing a technical advantage in regions of cold climate.

This advantage was confirmed by vehicle tests performed on a Cold Chamber Chassis Dynamometer, according to CEC Test Method M-11-T-91. In this test, a diesel-engined passenger car fuelled with test fuel oil is cooled in a cold climate chamber from 5° C. above fuel oil cloud point to a temperature of −30° C. over a 12 hour period, this latter temperature being held constant for 4 hours (a 'cold soak' period). The engine is then started from cold and the vehicle driven on a chassis dynamometer at a constant speed of 110 km/h, still at an air temperature of −30° C. The driveability performance of the vehicle is rated on a 'demerits' scale by an experienced operator where:

0 demerits corresponds to completely trouble-free driving, and 100 demerits corresponds to complete failure of the engine system.

Tests using a diesel-engined Ford Escort car were performed on the oil composition defined in Table 5, using additives hereinbefore described:

TABLE 5

| | Oil Composition | | | | |
|---|---|---|---|---|---|
| Example No. | Oil | Comb Polymer B (ppm, ai) | Co-additive IV (ppm, ai) | Kerosene (% wt) | Driveability Demerits at −30° C. |
| 24 | D | 180 | X | — | 0 demerits (PASS) |
| 25 | D | — | X | 20% | 48 demerits (FAIL) |

'—' means not present

The addition of kerosene to a diesel fuel oil is common practice in cold regions, kerosene being a lighter petroleum fraction and serving to improve the cold temperature flowability of the diesel fuel oil. In this test the benefit from using the additive of this invention far outweighed that obtained by significant kerosene addition (20% wt. by weight of diesel fuel oil).

We claim:

1. An oil composition comprising a major proportion of hydrocarbon oil having a cloud point no higher than −10° C., a final boiling point no higher than 360° C., the 20% and 90% distillation points of the oil differing by less than 100° C., and a minor proportion of an additive comprising a comb polymer containing units of the general formula (I)

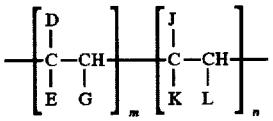

(I)

wherein

D represents $COOR^{11}$, $OCOR^{11}$ or $OR^{11}$ groups,

E represents H, $CH_3$, D or $R^{12}$ groups,

G represents H or D group,

J represents H, $R^{12}$ or an aryl or heterocyclic group,

K represents H, $COOR^{12}$, $OCOR^{12}$, $OR^{12}$ or COOH groups,

L represents H, $R^{12}$, $COOR^{12}$, $OCOR^{12}$ or aryl groups, and wherein $R^{12}$ represents a hydrocarbyl substituent containing from 1 to 6 carbon atoms and wherein $R^{11}$ represents a hydrocarbyl substituent different from $R^{12}$ and of average carbon number below 12 and wherein m and n represent mole ratios, their sum being 1 and m being finite and being up to and including 1 and n being from zero to less than 1, provided that E, G, J, K and L do not each represent H when D represents $COOR^{11}$ or $OCOR^{11}$.

2. The oil composition of claim 1 wherein the individual units of the polymer have $R^{11}$ substituents containing substantially the same number of carbon atoms.

3. The oil composition of claims 1 or 2 wherein the average carbon number of $R^{11}$ is at least 8.

4. The oil composition of claim 1 or 2 wherein $R^{11}$ and $R^{12}$ are n-alkyl groups.

5. The oil composition of claims 1 or 2 wherein the hydrocarbon oil is a mineral fuel oil or a fuel oil derived from animal or vegetable material, or a mixture thereof.

* * * * *